US009490114B2

(12) United States Patent
Furuhashi

(10) Patent No.: US 9,490,114 B2
(45) Date of Patent: Nov. 8, 2016

(54) TIME-OF-FLIGHT MASS SPECTROMETER

(71) Applicant: SHIMADZU CORPORATION, Kyoto-shi, Kyoto (JP)

(72) Inventor: Osamu Furuhashi, Uji (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 14/434,596

(22) PCT Filed: Sep. 18, 2013

(86) PCT No.: PCT/JP2013/075102

§ 371 (c)(1),
(2) Date: Apr. 9, 2015

(87) PCT Pub. No.: WO2014/057777

PCT Pub. Date: Apr. 17, 2014

(65) Prior Publication Data

US 2015/0270115 A1 Sep. 24, 2015

(30) Foreign Application Priority Data

Oct. 10, 2012 (JP) ..... 2012-224832

(51) Int. Cl.
*H01J 49/40* (2006.01)

(52) U.S. Cl.
CPC ..... *H01J 49/405* (2013.01)

(58) Field of Classification Search
CPC ..... H01J 49/405
See application file for complete search history.

(56) References Cited

U.S. PATENT DOCUMENTS 4,731,532 A * 3/1988 Frey ..... H01J 49/405 250/286
5,814,813 A * 9/1998 Cotter ..... H01J 49/405 250/282

(Continued)

FOREIGN PATENT DOCUMENTS

| | | |
|---|---|---|
| DE | 10 2010 039 030 | 2/2012 |
| GB | 2 371 143 | 7/2002 |
| WO | 2012/086630 A1 | 6/2012 |

OTHER PUBLICATIONS

Extended European Search Report issued Sep. 23, 2015 in European Patent Application No. 13846026.6.
Robert J. Cotter, et al., "Time-of-Flight Mass Spectrometry: Instrumentation and Applications in Biological Research", American Chemical Society, 1997, pp. 19-71 and 146-155.

(Continued)

*Primary Examiner* — Robert Kim
*Assistant Examiner* — Eliza Osenbaugh-Stewar
(74) *Attorney, Agent, or Firm* — Sughrue Mion, PLLC

(57) ABSTRACT

In an ion reflector (4) configured from a plurality of electrodes, electrodes 42 disposed in a second stage region (S2) for reflecting ions after deceleration are formed thinner than electrodes (41) disposed in a first stage region (S1) for decelerating the ions. The thin electrodes suppress unevenness of potential, in particular, in a path away from the center axis of the reflector, which results in improvement of isochronism of an ion packet passing on the path. The thick electrodes (41, 43) disposed in the first stage region (S1) prevents stretching of the grid electrodes (G1, G2) from being affected, and unevenness of potential in the first stage region (S1) hardly affects isochronism of the ions. By appropriately adjusting thicknesses and a pitch of the electrodes (41, 42, 43, 44) adjacent to one another so as to align intervals between the electrodes (41, 42, 43, 44), it is possible to use spacers having the same size in common. Since the number of electrodes in the first stage region (S1) can be reduced, an increase in costs is suppressed. Consequently, it is possible to bring an electric field of an ion reflection region closer to an ideal state and improve mass-resolving power while suppressing costs.

11 Claims, 10 Drawing Sheets

(56) References Cited

U.S. PATENT DOCUMENTS

| | | | | |
|---|---|---|---|---|
| 6,849,846 | B2 | 2/2005 | Bertsch | |
| 2003/0230726 | A1* | 12/2003 | Van der Veer | H01J 9/14 250/396 R |
| 2004/0036029 | A1* | 2/2004 | Bertsch | H01J 49/40 250/396 R |
| 2014/0312221 | A1* | 10/2014 | Verenchikov | H01J 49/405 250/282 |

OTHER PUBLICATIONS

B. A. Mamyrin, et al., "The mass-reflectron, a new nonmagnetic time-of-flight mass spectrometer with high resolution", Soy. Phys.—JETP, Jul. 1, 1973, pp. 45-48, vol. 37, No. 1.

T. Bergmann, et al., "High resolution time-of-flight mass spectrometers. Part III. Reflector design", Review of Scientific Instruments, Oct. 1990, pp. 2592-2600, vol. 61 (10).

International Search Report for PCT/JP2013/075102 dated Nov. 19, 2013 [PCT/ISA/210].

* cited by examiner

TIME-OF-FLIGHT MASS SPECTROMETER

TECHNICAL FIELD

The present invention relates to a time-of-flight mass spectrometer (hereinafter referred to as "TOFMS") using an ion reflector, and more specifically to the structure of the ion reflector.

BACKGROUND ART

In the TOFMS, the time of flight required for an ion packet (an aggregate of ions) ejected from an ion source supplied with a certain level of kinetic energy to reach a detector is measured, and the mass (or mass-to-charge ratio m/z, to be exact) of each ion is calculated from the time of flight. One major cause of deterioration in the mass-resolving power is spread in the initial energy of the ions. Spread in the initial energy of the ions ejected from the ion source causes broadening in the time-of-flight of the ions of the same mass, and deteriorates the mass-resolving power. To compensate for the time-of-flight broadening due to the initial energy spread of the ions, ion reflectors have been widely used. A TOFMS using the ion reflector is hereinafter called the "reflectron" according to the common practice.

An ion reflector has an electric potential distribution in which the potential increases in the traveling direction of the ions, and has the function of reflecting ions coming through a drift space with free of electric field. An ion having a larger initial energy (initial speed) penetrates deeper into the ion reflector, and hence spends a longer time flying in the ion reflector when reflected. On the other hand, the ion having a larger initial energy flies at a higher speed and hence spends a shorter time flying through a non-electric field drift space. Therefore, by appropriately adjusting the parameters so as to cancel the increase in the time of flight in the ion reflector by the decrease in the time of flight in the non-electric field drift space, the total time of flight from the ion source to the detector becomes almost independent of the initial energy within a certain range of energy (see Non-Patent Literature 1 for details).

Various types of reflectrons have been developed. A well-known reflectron is a dual-stage reflectron which was first developed by Mamyrin et al. (see Non-Patent Literature 2). FIG. 8A is a schematic diagram showing an ion path in the dual-stage reflectron. FIG. 8B is a schematic diagram of a potential distribution on the center axis.

In the dual-stage reflectron, an ion reflector is constructed by two stages of uniform electric fields (a uniform electric field is an electric field in which the potential changes proportional to the distance), i.e., a first stage region S1 and a second stage region S2. Grid electrodes G1 and G2 including a large number of openings through which ions can pass are respectively set in the boundary between a non-electric field drift region and the first stage uniform electric field (the first stage region S1) and the boundary between the first stage uniform electric field and the second stage uniform electric field (the second stage region S2). That is, the non-electric field drift region and the first stage region S1 are partitioned by the grid electrode G1. The first stage region S1 and the second stage region S2 are partitioned by the grid electrode G2. Usually, the first stage region S1 is shorter than the second stage region S2, and, provided that approximately two thirds of the initial energy of ions is lost in the first stage region S1, the total time-of-flight spread is compensated to the second derivative of the energy (that is, the second-order energy focusing is achieved). Therefore, the time-of-flight broadening for an ion packet having initial energy spread to some extent can be small. As a result, high mass-resolving power is obtained. Such a dual-stage reflectron is most widely used in commercially available time-of-flight mass spectrometers.

As explained above, in the dual-stage reflectron, basically, the electric fields are uniform electric fields in the stages of the ion reflector. It is known that energy-focusing performance can be improved by appropriately correcting the potential distribution of a part of the electric field to be a non-uniform electric field. For example, in Patent Literature 1, the present inventors propose a new TOFMS that realizes isochronism for an ion packet having energy equal to or larger than a certain energy threshold and flying on the center axis, by slightly correcting the potential distribution of the second stage region S2 in the dual-stage reflectron.

FIG. 9 is a schematic diagram of the potential distribution in the dual-stage reflectron described in Patent Literature 1. The position P in FIG. 9 is a second-order focusing position in the conventional dual-stage reflectron in which correcting potential is not superimposed. In a deeper space starting from the second-order focusing position P, correcting potential $Z_C(U)$ proportional to $\{U(Z)-E_0\}^{3.5}$ is superimposed on potential $Z_A(U)$ of the uniform electric field. If the correcting potential $Z_C(U)$ is not superimposed, the time-of-flight spread is compensated for up to the second derivative of energy (the conventional technique of Mamyrin solution). However, the time-of-flight spread is compensated for up to the third and infinitely continuing higher-order derivatives that cannot be compensated by the Mamyrin solution, by superimposing correcting potential $Z_C(U)$. Consequently, complete isochronism can be realized for ions reflected in the correcting potential portion. Potential distribution curves are smoothly connected before and behind the second-order focusing position P. Further, the correcting potential $Z_C(U)$ is extremely small compared with the potential $Z_A(U)$ of the uniform electric field. Therefore, not only theoretically, it is relatively easy to actually superimpose such correcting potential $Z_C(U)$. In the explanation, Z represents a coordinate along the center axis of the ion reflector, U represents a potential value in the coordinate Z, and $E_0$ represents a potential value in the second-order focusing position P.

According to the method explained above, it is possible in principle, to realize an ideal reflectron. In actual, it is necessary to form a theoretically calculated ideal correcting potential distribution on the center axis inside the ion reflector. However, it is difficult in a conventional general ion reflector to form this highly accurate potential distribution. A reason for this is explained below.

In general, an ion reflector forms an ion reflection electric field in its internal space with a plurality of guard-ring electrodes. FIG. 10 is a configuration diagram of a general ion reflector 4 including a plurality of guard-ring electrodes. A guard-ring electrode 401 is a substantially annular metal plate including an opening in the center. The shape of the opening is various, such as circular or rectangular, according to the path shapes of ions. Between adjacent guard-ring electrodes 401 of thickness Te, an insulating spacer 402 having thickness Ts is disposed. Thus, the interval between the adjacent two guard-ring electrodes 401 is Ts. As shown in the drawing, in the conventional general dual-stage reflectron, the guard-ring electrode 401 and the spacer 402 having the same shapes are used in the first stage region S1 and the second stage region S2. The main reason is to reduce costs by using the guard-ring electrode 401 and the spacer 402 in common.

The mass-resolving power of the general TOFMS currently on the market is 10000 or more. To realize the high mass-resolving power to this extent, it is necessary to dispose the guard-ring electrode 401 at high position accuracy in micron order. Therefore, it is necessary to manufacture the guard-ring electrode 401 and the spacer 402 at high accuracy, and further assemble them at high accuracy. Patent Literature 2 describes a method of disposing guard-ring electrodes at high position accuracy and inexpensively realizing the guard-ring electrodes. In the literature, the thicknesses of a plurality of guard-ring electrodes are the same, and the interval between adjacent electrodes, that is, the thicknesses of spacers, are also the same.

To form the non-uniform ideal potential distribution as described above along the center axis inside the ion reflector, it is desirable to dispose as many number of guard-ring electrodes at as narrow intervals as possible (i.e., at as high density as possible). It is also desirable to make the guard-ring electrodes as thin as possible. Further it is desirable to make the inner circumferential edge of the guard-ring electrodes as close as possible to the center axis.

The above explanation about the disposition and the shape of the guard-ring electrodes is illustrated using an example of simulated calculation on potential distributions in the inner space of the guard-ring electrodes. The configuration and the shape of the guard-ring electrodes used for the calculation are shown in FIG. 11A. The guard-ring electrodes have a shape rotationally symmetrical with respect to the Z axis. The diameter of the opening through which ions pass is 100 [mm]. Both the thickness Te of the guard-ring electrodes and the thickness Ts of the spacers (the interval between the adjacent electrodes) are 10 [mm]. The grid electrode G is placed at a position half the thickness of a guard-ring electrode, that is, the position of Tf=Te/2=5 [mm] thickness. To form a uniform electric field along the Z axis in the guard-ring electrodes having such a shape, applied voltages to the guard-ring electrodes are set to 0, 200, 400, 600, 800, and 1000 [V] respectively from the incident end electrode.

FIG. 11B shows a calculation result of the potential distributions formed in the spaces in the guard-ring electrodes. Equipotential surfaces are shown at a 20 [V] interval. FIG. 12 is potential distributions on the Z axis (Y=0) and the line parallel to the Z axis at Y=50 [mm]. FIG. 13 is an ideal potential distribution of the uniform electric field (Videal) and a distribution of deviation (ΔV=V−Videal) between the ideal potential of the uniform electric field and potential actually formed on the Z axis and lines parallel to the Z axis at Y=10, 20, 30, 40, and 50 [mm].

The following is found from the results shown in FIG. 11 to FIG. 13.

(1) According to FIG. 12 and FIG. 13, although the actual potential distribution is close to the ideal potential of the uniform electric field near the center axis (Y=0) of the ion reflector, the deviation between the ideal potential and the actual potential increases at a position further away from the center axis and closer the guard-ring electrode 401 (i.e., Y is larger).

(2) As shown in FIG. 11B, a curve of an equipotential surface is larger at a position closer to the guard-ring electrode 401. Since it is certain that, if the guard-ring electrode 401 is thinner, the curvature will be smaller (curve will be milder), it is apparent that the deviation of the potential explained in (1) is caused by the thickness of the guard-ring electrode 401. In other words, it is considered that, as the guard-ring electrode 401 is thinner, deviation of the potential at a position away from the center axis by distance Y is smaller (the deviation is zero if the guard-ring electrode is infinitely thin).

As explained above, the guard-ring electrode should be as thin as possible to form the ideal potential distribution in the ion reflector. However, actually, there are limitations. As shown in FIG. 8B and FIG. 9, the grid electrodes G1 and G2 are provided respectively at the boundary between the non-electric field drift region and the first stage region S1 of the ion reflector, and at the boundary between the first stage region S1 and the second stage region S2 of the ion reflector in order to form electric fields having different strengths on the both sides of the boundaries and to allow ions to pass. If the grid electrode G1 or G2 has bent or slack, distortion in the potential distribution inside the ion reflector appears. Therefore, to achieve high performance, it is necessary to stretch the grid electrodes at high flatness. For example, Non-Patent Literature 3 describes a method of stretching the grid electrodes without slack. If the grid electrodes are stretched on the inner circumferential wall surface facing the center opening of the guard-ring electrode, structurally speaking, the guard-ring electrode needs to be thicker than a certain value. Typically, to stretch the grid-electrodes without slack, the thickness of the guard-ring electrode needs to be approximately 5 to 10 [mm] or more.

In a so-called gird-less reflector, commercialized by some manufacturers, which does not use a grid at the boundary before and behind a first stage region, in some case, the thickness of a guard-ring electrode is as thin as approximately 2 [mm] or less. However, it is practically impossible to stretch a grid electrode at such thickness of a guard-ring electrode. In such a grid-less reflector, as in the ion reflector using grids, the guard-ring electrode and the spacer having the same shapes are respectively used in all regions in common.

In the simulation, the thickness of the guard-ring electrode is set to 10 [mm] taking into account such circumstances. However, as it is evident from the above result, when the guard-ring electrode is thick to this degree, unevenness of a potential distribution at a position, in particular, away from the center axis in the radial direction is conspicuous. As a result, even if it is attempted, for example, to superimpose the correcting potential on the potential of the uniform electric field to form the ideal potential distribution, the deviation between the actually obtained potential and the ideal potential increases and deterioration in isochronism for the ion packet increases.

In the following explanation, with respect to the guard-ring electrodes of the ion reflector, such terms as "thick electrode" and "thin electrode" are used. In relation to the conventional technique explained above, the "thick electrode" indicates an electrode having thickness of approximately 5 to 10 mm or more. On the other hand, the "thin electrode" indicates an electrode having thickness of approximately 2 [mm] or less.

CITATION LIST

Patent Literature

[Patent Literature 1] WO2012/086630
[Patent Literature 2] U.S. Pat. No. 6,849,846 A

Non Patent Literature

[Non Patent Literature 1] R. J Cotter, "Time-of-Flight Mass Spectrometry: Instrumentation and Applications in Biological Research" American Chemical Society, 1997

[Non Patent Literature 2] B. A. Mamyrin and three others, "The mass-reflectron, a new nonmagnetic time-of-flight mass spectrometer with high resolution", Sov. Phys.-JETP 37, 1973, p. 45-48

[Non Patent Literature 3] T. Bergmann and two others, "High resolution time-of-flight mass spectrometers. Part III. Reflector design", Review of Scientific Instruments, 61(10), 1990, p. 2592-2600

SUMMARY OF INVENTION

Technical Problem

The present invention has been devised to solve the problems and it is an object of the present invention to provide a TOFMS including an ion reflector that can bring a formed reflection electric field closer to an ideal state while suppressing costs.

Solution to Problem

The present invention devised to solve the problems is a time-of-flight mass spectrometer including: an ion ejector configured to impart a predetermined amount of energy to target ions; a non-electric field ion drift region configured to let the ions to fly freely; an ion reflector including a plurality of plate-like electrodes disposed along an ion path in order to reflect and return, with action of an electric field, the ions flown in the non-electric field ion drift region; a detector configured to detect the ions reflected by the ion reflector and returning through the non-electric field ion drift region, wherein a flight space of the ions by the ion reflector is sectioned into a first region where a deceleration electric field for decelerating the ions passed through the non-electric field ion drift region is formed and a second region where a reflection electric field for reflecting the ions decelerated in the first region is formed, and thickness of the plurality of electrodes disposed in the second region is set small compared with thickness of the plurality of electrodes disposed in the first region.

In the present invention, the reflection electric field formed in the second region only has to be an electric field for reflecting the ions decelerated by the deceleration electric field in the first region at a position corresponding to initial energy of the ions.

As explained above, in the conventional general reflectron, the thicknesses of all the guard-ring electrodes constituting the ion reflector are the same. On the other hand, in the TOFMS according to the present invention, the thicknesses of the electrodes are made different between the first region having the action of only the deceleration for the ions and the second region having the action of reflecting the ions. The electrodes are thicker in the first region than in the second region. As a specific mode, it is desirable to set the thickness of each of the plurality of electrodes disposed in the second region to approximately 2 mm or less, and set the thickness of each of the plurality of electrodes disposed in the first region to 5 to 10 mm or more.

When the electrodes (the guard-ring electrodes) constituting the ion reflector are increased in thickness as explained above, in particular, the curve of the equipotential surface at the position away from the center axis in the radial direction increases and deviation from the ideal potential increases. However, according to a study using the simulated calculation by the present inventors, the deviation of the potential in the first region where only the deceleration of the ions is performed does not considerably affect time focusing of the ions, and does not substantially spoil isochronism. On the other hand, the deviation of the potential in the second region where the reflection for the ions is performed considerably affects the time focusing of the ions. In the TOFMS according to the present invention, since the electrodes (the guard-ring electrodes) are thin in the second region, compared with the first region, the deviation from the ideal potential is suppressed even at the position away from the center axis in the radial direction. Consequently, it is possible to secure isochronism of the ion packet and attain high mass-resolving power.

As a typical mode of the time-of-flight mass spectrometer according to the present invention, the non-electric field ion drift region and the first region of the ion reflector are partitioned by a grid-like electrode stretched to the opening of an electrode constituting the ion reflector, and the first region and the second region of the ion reflector are also partitioned by a grid-like electrode stretched to the opening of an electrode constituting the ion reflector. That is, the TOFMS is a gridded reflectron, rather than a grid-less reflectron. The non-electric field ion drift region and the first region of the ion reflector and the first region and the second region of the ion reflector are respectively partitioned by the grid-like electrodes (grid electrodes) to prevent, electric fields from interfering with each other, with the grid-like electrodes set as boundaries.

In the time-of-flight mass spectrometer having the mode explained above, it is desirable that the grid-like electrode that partitions the non-electric field ion drift region and the first region of the ion reflector is stretched to an electrode having thickness equal to or larger than a half ($Tf1=Te1/2$) of thickness ($Te1$) of the other electrodes having same thickness disposed in the first region, and a stretching position of the grid-like electrode is a position of $Tf1$ from a deeper side of the reflector. It is desirable that the grid-like electrode that partitions the first region and the second region of the ion reflector is stretched to an electrode having thickness equal to a sum ($(Te1/2)+(Te2/2)$) of a half of thickness of the other electrodes having the same thickness ($Te1$) disposed in the first region and a half of thickness of the electrodes having the same thickness ($Te2$) disposed in the second region, and a stretching position of the grid-like electrode is a position of $Tf2$ from the deeper side of the reflector.

With this configuration, the grid-like electrodes only have to be stretched to, rather than the thin electrodes disposed in the second region, the electrodes that are thick compared with the electrodes. Therefore, it is possible to stretch the grid-like electrodes without bend and slack while using the thin electrode in the second region, and to avoid distortion of a potential distribution inside the ion reflector due to the electrodes.

As explained above, the influence on isochronism due to the thick electrode disposed in the first region is small. In order to further improve the mass-resolving power, it is desirable to form an opening of the thick electrode disposed in the first region larger than an opening of the thin electrode disposed in the second region.

As the curve of the equipotential surface due to the thick electrode is large in the vicinity of the electrode inner circumferential edge portion facing the opening, widening the opening softens the curve degree of the equipotential surface at the position having the same distance from the center axis. Consequently, the deviation between the actual potential and the ideal potential at the position having the same distance from the center axis decreases. The broadening of the time-of-flight which occurs in the ions passing a path deviating from the center axis in the first region decreases. This leads to improvement of comprehensive isochronism.

In order to further reduce manufacturing costs of the ion reflector, a member constituting the thick electrode disposed in the first region and a member constituting the thin electrode disposed in the second region may be a common member. That is, the thick electrode disposed in the first region is formed by stacking a plurality of the thin electrodes disposed in the second region. By using a general-purpose machining technique such as etching or punching, it is possible to inexpensively produce a large number of thin electrodes having the same shape from a thin large metal plate. Therefore, if the thick electrode is formed using the thin electrode, costs can be reduced compared with the thick electrode manufactured by machining.

In the time-of-flight mass spectrometer according to the present invention, preferably, spacers are sandwiched between the electrodes adjacent to one another in the electrodes configuring the ion reflector, and the thickness of the electrodes and the disposition of the electrodes are adjusted so that all the spacers have the same thickness. This configuration enables all the spacers to be common, which reduces manufacturing costs of the ion reflector and facilitates adjustment during assembly.

Advantageous Effects of Invention

With the time-of-flight mass spectrometer according to the present invention, the electrodes can be disposed at high density because of the thin electrodes disposed in the second region. This minimizes the distortion of the equipotential surface due to the thickness of the electrodes to form the ideal correcting potential described in Patent Literature 1. Consequently, it is possible to realize a reflectron close to an ideal state as well as high mass-resolving power. Increasing the thickness of the electrodes disposed in the first region and widening the interval of the electrodes reduce the number of the electrodes disposed in the first region. Even in that case, the potential correction in the second region secures device performance such as the mass-resolving power, and a cost reduction is attained by reducing the number of the electrodes in a range not affecting performance.

DESCRIPTION OF EMBODIMENTS

Figure 14:
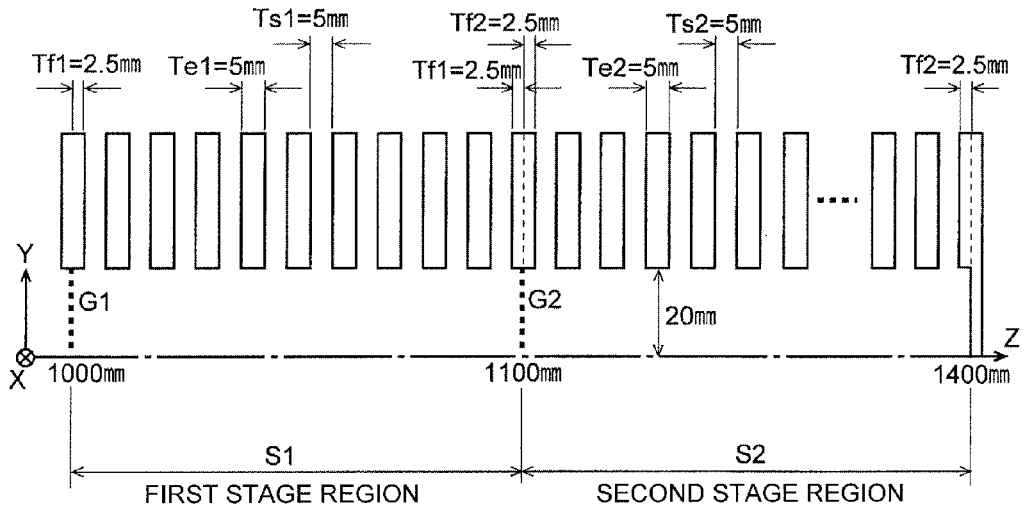
FIG. 14 is a diagram showing the structure of guard-ring electrodes of a conventional ion reflector used for a simulation for comparing with the ion reflector according to the present invention.

Before explaining an embodiment of the present invention, a detailed simulation result of deviation of potential and a relation between a relative energy spread and a relative time-of-flight spread due to the deviation in the electrode structure of the conventional ion reflector is explained. FIG. 14 is a diagram showing the electrode structure of the conventional ion reflector assumed in the simulation. The ion reflector assumed herein is a slit-shaped electrode that is a planar symmetrical structure in an X-axis direction and reflectional symmetry with respect to an X-Z plane. Therefore, in FIG. 14, the electrode structure only in a plane in a +Y direction including the X-Z plane is drawn. This is the same in FIG. 2 to FIG. 4 and FIG. 7 referred to below.

As shown in FIG. 14, the ion reflector has the common structure in which both of a first stage region S1 and a second stage region S2 have guard-ring electrodes of the same thickness and spacers of the same thickness. The length of a non-electric field drift region is 1000 [mm], the length of the first stage region S1 is 100 [mm], and the length of the second stage region S2 is 300 [mm]. The thickness of one guard-ring electrode is Te1=Te2=5 [mm]. The guard-ring electrode is a so-called thick electrode to be easily stretched grid electrode. The thickness of the spacers is Ts1=Ts2=5 [mm]. A first grid electrode G1 is attached at a position of a half in the thickness direction of a beginning guard-ring electrode, that is a position of thickness Tf1=2.5 [mm]. A second grid electrode G2 is attached at a position of a half in the thickness direction of a predetermined guard-ring electrode, that is, a position of thickness Tf1=Tf2=2.5 [mm]. Slit-type opening width of the guard-ring electrodes is 40 [mm].

Voltages were respectively applied to the guard-ring electrodes of the ion reflector set as explained above and adjusted for obtaining an ideal potential distribution on a center path (the Z axis in FIG. 14). A time of flight of ions was examined with a simulation by changing initial energy of the ions. The method described in Patent Literature 1 was used to obtain the ideal potential distribution. That is, in a deeper side (the right side in FIG. 14) starting from a second-order focusing position set in the second stage region S2, correcting potential $Z_C(U)$ proportional to $\{U(Z)-E_0\}^{3.5}$ is superimposed on potential $Z_A(U)$ of the uniform electric field to cancel even a third-order or higher temporal aberration.

Figure 15:
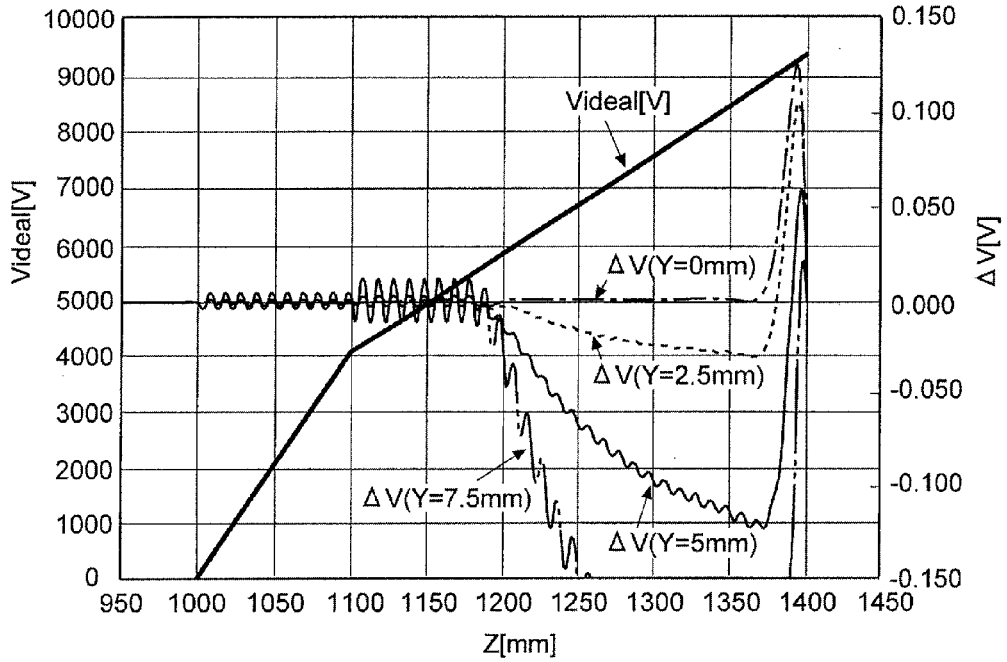
FIG. 15 is a diagram showing a simulation result of potential distributions on a center axis and on paths deviating from the center axis in the ion reflector having the structure shown in FIG. 14.

FIG. 15 is a diagram showing a simulation result of potential distributions on a center axis (Y=0 [mm]) and paths (Y=2.5, 5, and 7.5 [mm]) deviating from the center axis in the ion reflector having the structure shown in FIG. 14. In the figure, Videal represents an ideal potential distribution obtained by superimposing correcting potential on potential of the uniform electric field and ΔV represents a distribution of potential deviation between ideal potential and actual potential.

Figure 16:
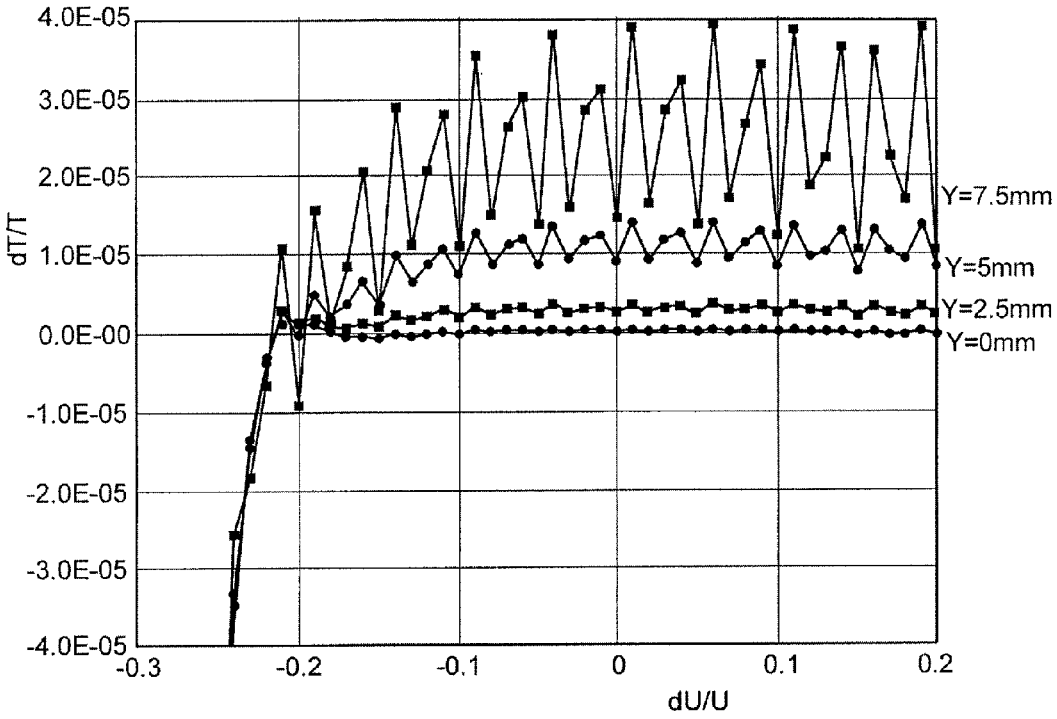
FIG. 16 is a diagram showing a simulation result of a relative time-of-flight spread dT/T with respect to a relative energy spread dU/U in the case in which ions fly on the center axis and the tracks deviating from the center axis in the ion reflector having the structure shown in FIG. 14.

FIG. 16 is a diagram showing a simulation result of a relative time-of-flight spread dT/T with respect to a relative energy spread dU/U in the case in which ions fly on the center axis and the paths deviating from the center axis in the ion reflector having the structure shown in FIG. 14. The ordinate dT/T of FIG. 16 represents a time of flight as a relative value with reference to a time of flight at the time when the relative energy spread dU/U of the ions is 0 and Y=0 (i.e., on the center axis). In FIG. 16, ions having the relative energy spread dU/U of −0.2 correspond to ions reflected at a second-order focusing position (a correcting potential start point). Ions having $-0.2<dU/U<0.2$ correspond to ions reflected at a region where the correcting potential is superimposed on the potential of the uniform electric field. Isochronism is realized for these ion packets flying on the center axis.

Looking at the potential distribution inside the ion reflector shown in FIG. 15, since the correcting potential is superimposed as explained above, it is seen that Y-coordinate dependency of a potential distribution is more conspicuous on the region deeper than the vicinity of a correction start point near Z=1180. The potential deviation ΔV is substantially zero and ideal potential can be substantially realized on the center axis (Y=0 [mm]). On the other hand, further away from the center axis, the potential deviation ΔV increases and unevenness is clearly observed in the deviation of the potential. The unevenness coincides with a pitch of the guard-ring electrodes, which means that the unevenness of the deviation of the potential is due to the thickness of the guard-ring electrodes.

Looking at initial energy dependency of the time of flight shown in FIG. 16, it is seen that variation of the time of flight due to the unevenness of the potential clearly increases with an increase in a Y coordinate (further away from the center axis). Since the mass-resolving power is given by R=(½)(T/dT), a time difference dT/T=1E-5 corresponds to mass-resolving power 50000 and a time difference dT/T=2E-5 corresponds to resolving power 25000. From these results, it is seen that, in the structure of the conventional ion reflector, although high mass-resolving power is obtained as long as a flight space of the ions is limited to a narrow region around the center axis, the position away from the center axis 5 [mm] or more incurs the unevenness of the potential formed by the guard-ring electrodes in the second stage region S2 and thus the time of flight spread, which results in deterioration in the mass-resolving power.

As explained above, a cause of such deterioration of the mass-resolving power is the thickness of the guard-ring electrodes in the ion reflection region (in this example, the second stage region S2). Therefore, in the present invention, by forming the guard-ring electrodes thinner than those in the past in the ion reflection region, the mass-resolving power is improved for, in particular, the ions passing on the paths away from the center axis.

Figure 1:
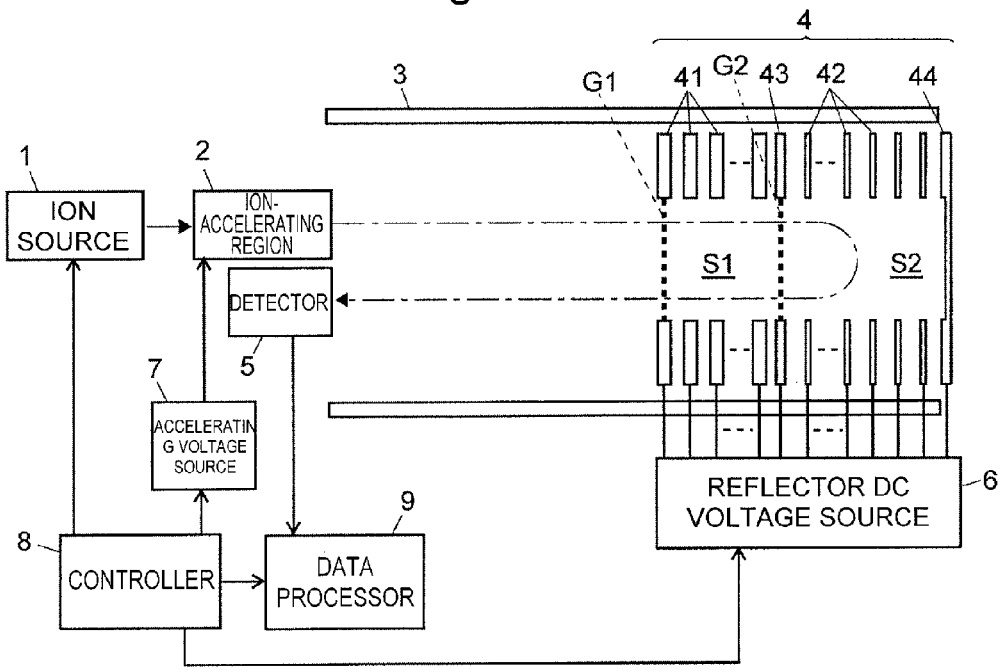
FIG. 1 is a schematic configuration diagram of a TOFMS according to an embodiment of the present invention.
Figure 2:
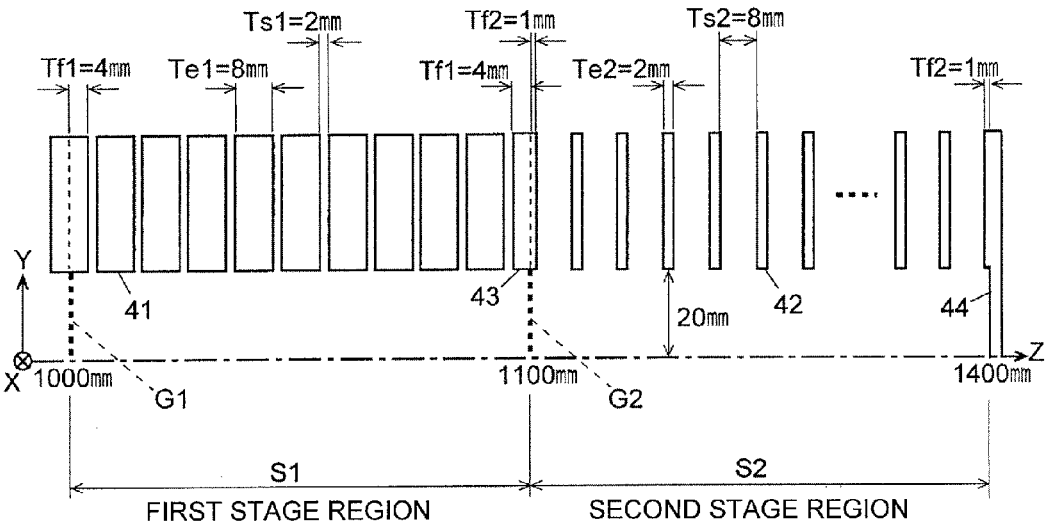
FIG. 2 is a diagram showing the electrode structure of an ion reflector in the TOFMS in the embodiment.
Figure 3:
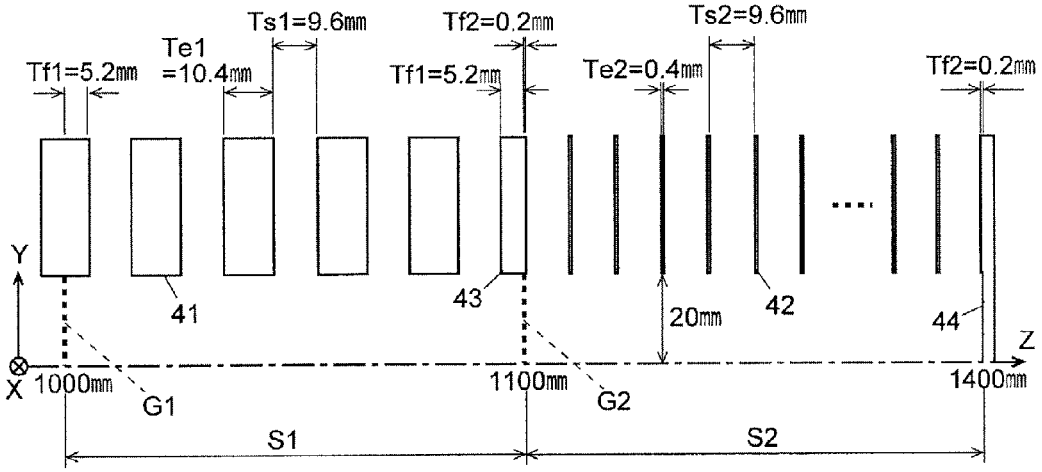
FIG. 3 is a diagram showing a modification of the electrode structure of the ion reflector in the TOFMS in the embodiment.
Figure 4:
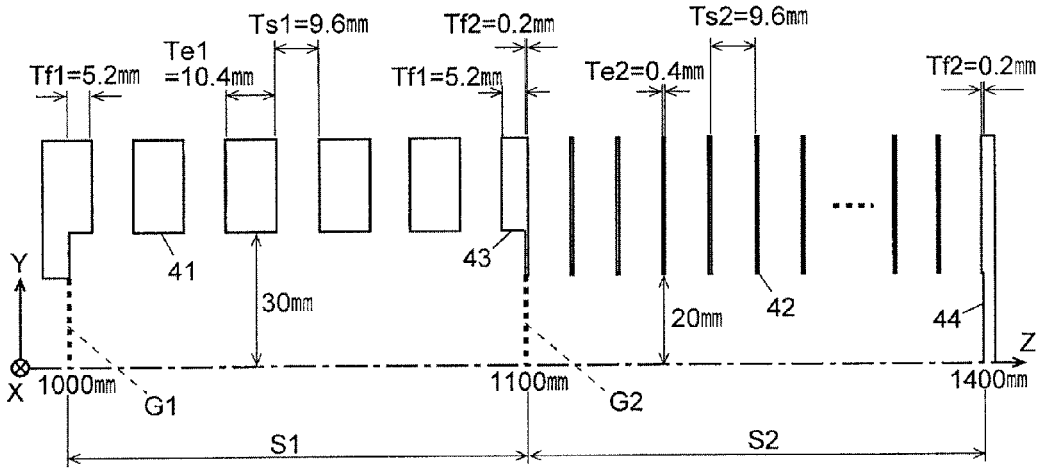
FIG. 4 is a diagram showing a modification of the electrode structure of the ion reflector in the TOFMS in the embodiment.

A TOFMS in the embodiment of the present invention is explained below with reference to the accompanying drawings. FIG. 1 is a schematic configuration diagram of the TOFMS in this embodiment. FIG. 2 is a diagram showing the electrode structure of an ion reflector in the TOFMS in this embodiment. FIG. 3 and FIG. 4 are diagrams respectively showing modifications of the electrode structure of the ion reflector.

In FIG. 1, ions deriving from a sample generated by an ion source 1 are introduced into an ion-accelerating region 2. The ions are given initial energy by an electric field formed by a voltage applied to the ion-accelerating region 2 from an accelerating voltage source 7 in a pulse-like manner at predetermined timing and are sent to a flight space in a flight tube 3. An ion reflector 4 including a plurality of guard-ring electrodes 41, 42, and 43 and a terminal end electrode 44 disposed along an ion optical axis is set in the flight tube 3. A first grid electrode G1 is stretched to an opening of the guard-ring electrode 41 closest to the ion-accelerating region 2 among the electrodes. A second grid electrode G2 is stretched to an opening of another guard-ring electrode 43.

Predetermined direct-current (DC) voltages are respectively applied to the guard-ring electrodes 41, 42, and 43 and the terminal end electrode 44 constituting the ion reflector 4 from a reflector DC voltage source 6 so that a static electric field (a direct-current electric field) having a predetermined potential shape is formed in an internal space of the ion reflector 4. The ions are reflected in the ion reflector 4 by the action of the electric field. The ions thus reflected and returned reach a detector 5. The detector 5 outputs a detection signal corresponding to a quantity of the reached ions. A controller 8 controls the accelerating voltage source 7, the reflector DC voltage source 6, and the like. A data processor 9 acquires timing information of acceleration of the ions, that is, information concerning flight start time from the controller 8, measures a flight time with reference to the timing information based on detection signals obtained from the respective ions, and converts the flight time into a mass-to-charge ratio m/z to create a mass spectrum.

The ion source 1 can be an ion source using any ionization method such as MALDI, ESI, APCI, EI, or CI according to a form of a sample. The ion-accelerating region 2 only has to be a three-dimensional quadruple ion trap, a linear ion trap, or the like. When the ion source 1 is the ion source of MALDI or the like, the ion-accelerating region 2 may be a mere accelerating electrode that extracts and accelerates the ions generated by the ion source 1. To suppress variation of the initial energy of the ions, it is desirable to adopt an orthogonal acceleration method of accelerating the ions extracted from the ion source 1 in a direction orthogonal to the extracting direction from the ion source and sends the ions into the flight tube 3. In that case, the ion-accelerating region 2 can be configured from a pusher electrode and one or a plurality of grid electrodes.

As shown in FIG. 2, the guard-ring electrodes 41 including the beginning guard-ring electrode disposed between the first grid electrode G1 and the second grid electrode G2 (that is, in the first stage region S1) have thickness Te1 of 8 [mm], while the guard-ring electrodes 42 disposed between the second grid electrode G2 and the terminal end electrode 44 (that is, in the second stage region S2) have thickness Te2 of 2 [mm]. That is, in this example, the thickness Te1 of the guard-ring electrodes 41 disposed in the first stage region S1 equivalent to the first region in the present invention is four times as large as the thickness Te2 of the guard-ring electrodes 42 disposed in the second stage region S2 equivalent to the second region in the present invention. The former is a so-called thick electrode and the latter is a so-called thin electrode. In both of the first stage region S1 and the second stage region S2, a pitch of the guard-ring electrodes 41 and 42 is set to 10 [mm]. Therefore, in the first stage region S1, a gap between the guard-ring electrodes 41 adjacent to each other is Ts1=2 [mm]. In the second stage region S2, a gap between the guard-ring electrodes 42 adjacent to each other is Ts2=8 [mm]. Slit-type opening width of the guard-ring electrodes 41, 42, and 43 is 40 [mm].

The first grid electrode G1 is attached to the top guard-ring electrode 41 in a position of a half in the thickness direction of the guard-ring electrodes 41 disposed in the first stage S1, that is, a position of thickness Tf1=Te1/2=4 [mm] from the deeper side of the reflector. Therefore, in the beginning guard ring electrode, the thickness of a portion facing (included in) the first stage region S1 across the first grid electrode G1 is 4 [mm]. On the other hand, the thickness of the guard-ring electrode 43, to which the second grid electrode G2 is attached, is 5 [mm] obtained by adding up a half of the thickness Te1=8 [mm] of the guard-ring electrodes 41 disposed in the first stage region S1 and a half of the thickness Te2=2 [mm] of the guard-ring electrodes 42 disposed in the second stage region S2. The second grid electrode G2 is attached to a position of 4 [mm] from an end on the first stage region S1 side of the guard-ring electrode 43. The thickness of a portion facing (included in) the first stage region S1 across the second grid electrode G2 is 4 [mm]. The thickness of a portion facing (included in) the second stage region S2 is 1 [mm]. By setting the substantial thicknesses of the electrodes at the ends (start end and terminal end) of the stages to the halves of the thicknesses of the electrodes included in the stages, it is possible to form an ideal uniform electric field even near the grid electrodes.

Figure 10:
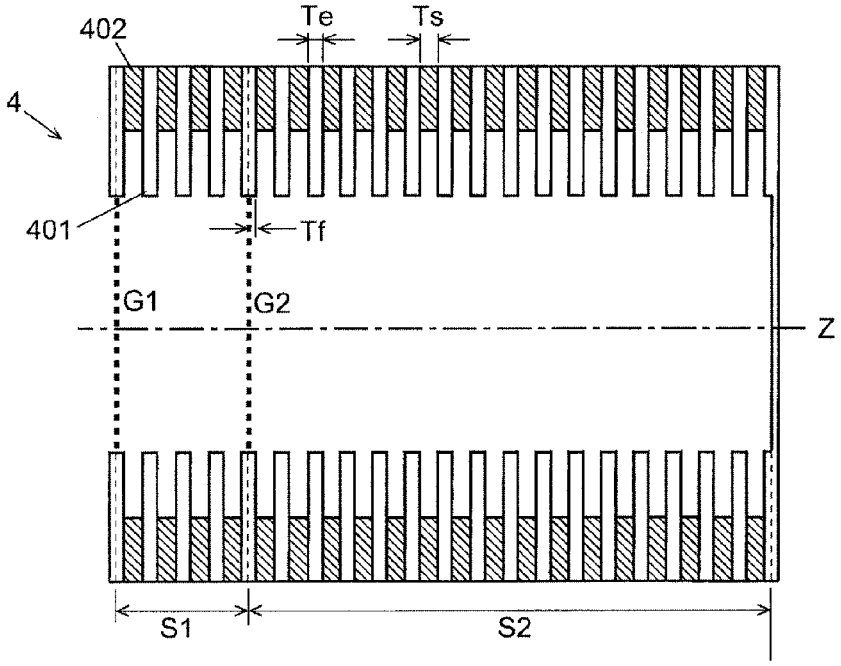
FIG. 10 is a configuration diagram of a general ion reflector.
Figure 11A:
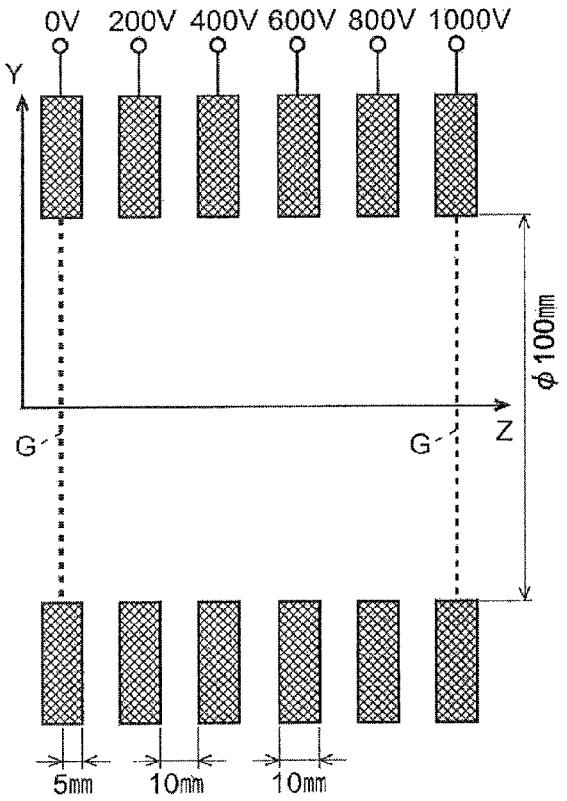
FIG. 11A is a diagram showing the configuration and the shape of guard-ring electrodes used for a simulation and FIG. 11B is a diagram showing a simulation result of potential distributions formed in spaces in the guard-ring electrodes.
Figure 11B:
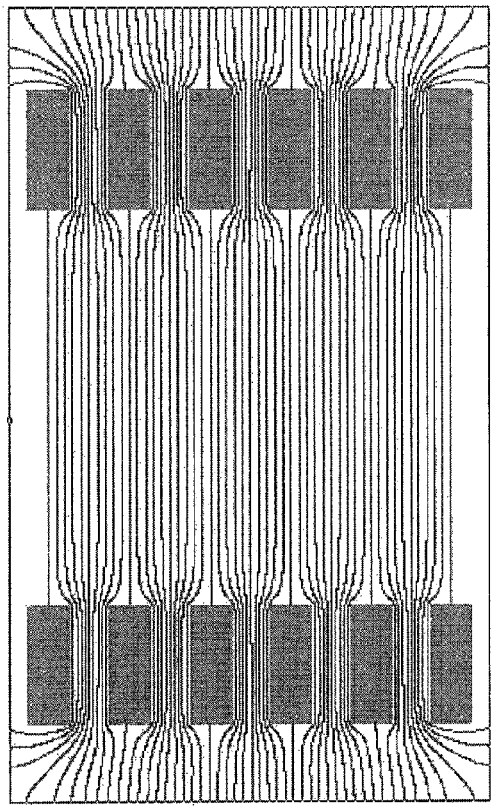
Figure 12:
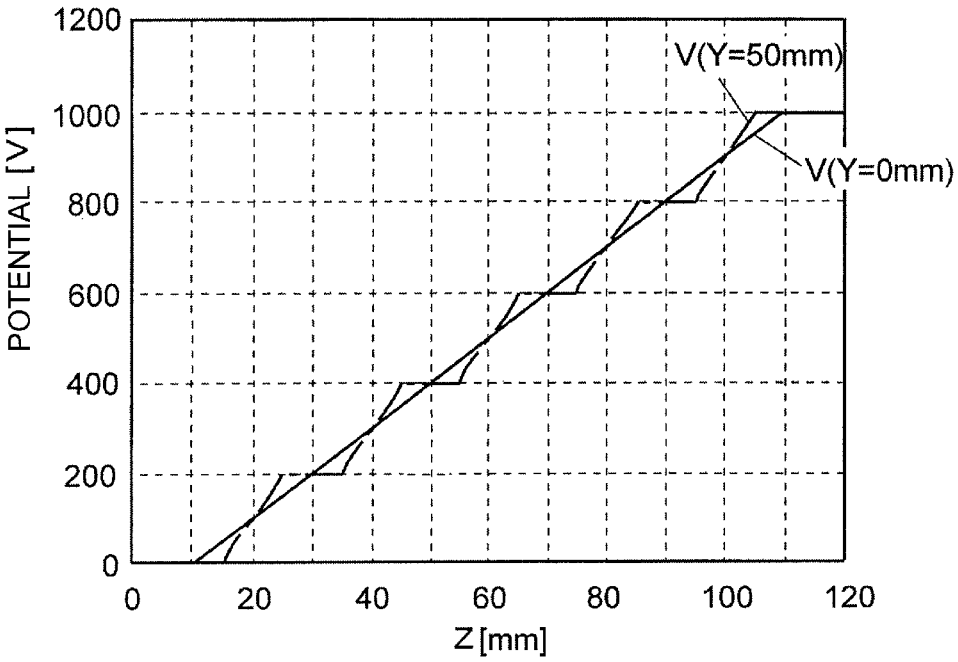
FIG. 12 is a diagram showing potential distributions on a Z axis (Y=0) ant on a line parallel to the Z axis at Y=50 [mm].
Figure 13:
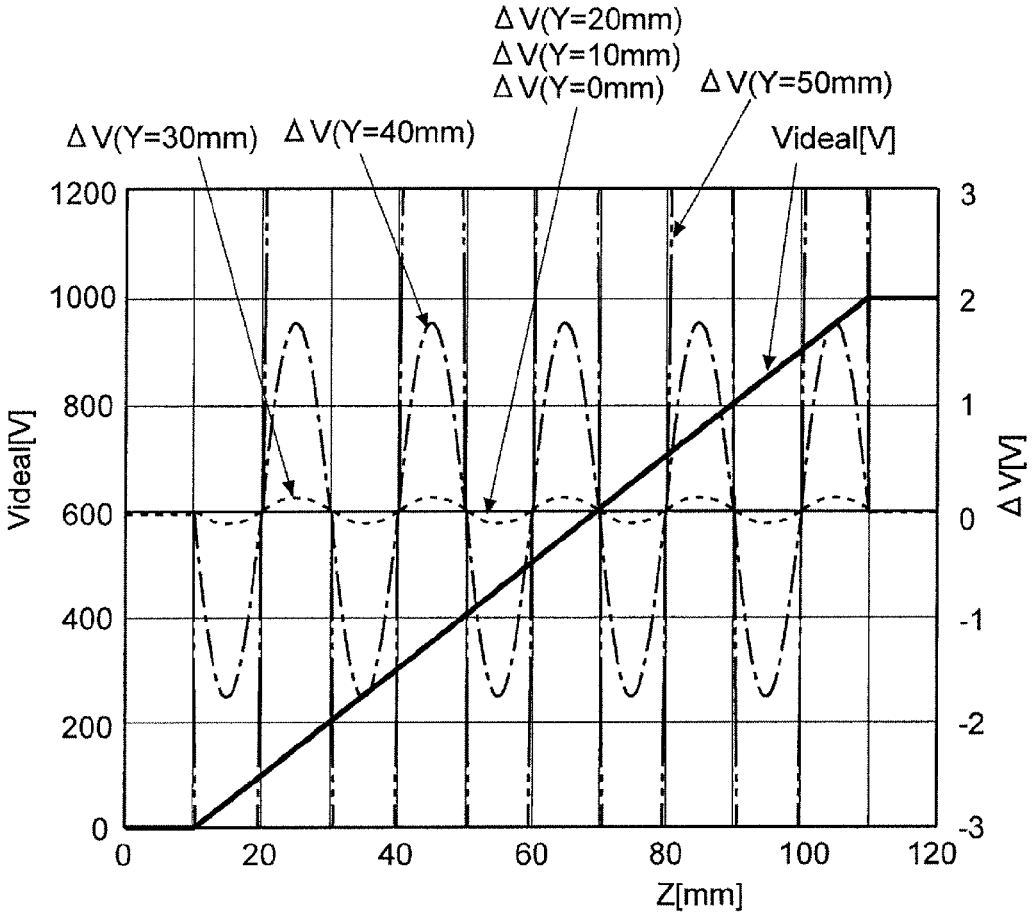
FIG. 13 is a diagram showing an ideal potential distribution by a uniform electric field and a distribution of deviation between the ideal potential distribution by the uniform electric field and potentials actually formed on the Z axis and lines parallel to the Z axis at Y=10, 20, 30, 40, and 50 [mm].

As shown in FIG. 2, the guard-ring electrodes 42 disposed in the second stage region S2 are considerably thin compared with the conventional general thickness of 5 to 10 [mm]. Therefore, a curve of an equipotential surface is small even in a position away from the center axis in the radial direction. Therefore, a spread of a time of flight decreases. In this configuration, unlike the conventional configuration shown in FIG. 10, spacers inserted among the guard-ring electrodes cannot be used in common due to the difference on the gaps (Ts1 and Ts2) between the adjacent guard-ring electrodes 41, 42 and 43 in the first stage region S1 and the second stage region S2. This leads to an increase in costs. To address this, the pitch of the guard-ring electrodes and the thickness of the guard-ring electrodes are adjusted in each of the first stage region S1 and the second stage region S2 to modify the structure shown in FIG. 2. FIG. 3 shows the modified structure.

That is, in the modified structure shown in FIG. 3, the thickness of the guard-ring electrodes 42 disposed in the second stage region S2 is further reduced to Te2=0.4 [mm]. The interval between the adjacent electrodes, that is, the thickness of the spacers is adjusted to Ts1=Ts2=9.6 [mm] common to the first stage region S1 and the second stage region S2. Accordingly, the electrode pitch of the guard-ring electrodes 41 disposed in the first stage region S1 is increased to 20 [mm]. The thickness of the electrodes 41 is further increased to Te1=10.4 [mm]. In such a configuration, the spacers having the same size can be used for all the spacers, which results in cost reduction compared with the configuration shown in FIG. 2 requiring the two kinds of spacers having the different sizes. The number of the guard-ring electrodes 41 disposed in the first stage region S1 is also reduced from nine to four. Decreasing the number of electrodes requiring high accurate work contributes to cost reduction.

On the other hand, unevenness of the potential on the center axis in the first stage region S1 increases because of an increase in thickness of the guard-ring electrodes 41 disposed in the first stage region S1. As explained below, actually, although the unevenness of the potential in the first stage region S1 hardly affects overall isochronism, when realization of higher isochronism is taken into account, it is desirable to suppress the unevenness of the potential in the first stage region S1 as much as possible. To address this, the center opening of the guard-ring electrodes 41 disposed in the first stage region S1 is widened to further modify the structure shown in FIG. 3. FIG. 4 shows the modified structure.

As shown in FIG. 4, in the structure of the modification, slit width of the guard-ring electrodes 41 disposed in the first stage region S1 is increased to 60 [mm]. Otherwise, the structure is the same as that shown in FIG. 3. Based on the electrode structure of the ion reflector shown in FIG. 4, which is more advantageous than the structure shown in FIG. 2 in terms of costs and has performance equivalent to or higher than the structure shown in FIG. 3, simulation calculation was performed by the same method employed in the conventional ion reflector, and the result of the simulation calculation was compared with the result by the conventional ion reflector. In this case, in the deeper space (the right in FIG. 4) starting from a second-order focusing position set in the second stage region S2, correcting potential $Z_C(U)$ proportional to $\{U(Z)-E_0\}^{3.5}$ is superimposed on potential $Z_A(U)$ of the uniform electric field using the method described in Patent Literature 1 to form an ideal potential distribution on the center axis.

Figure 5:
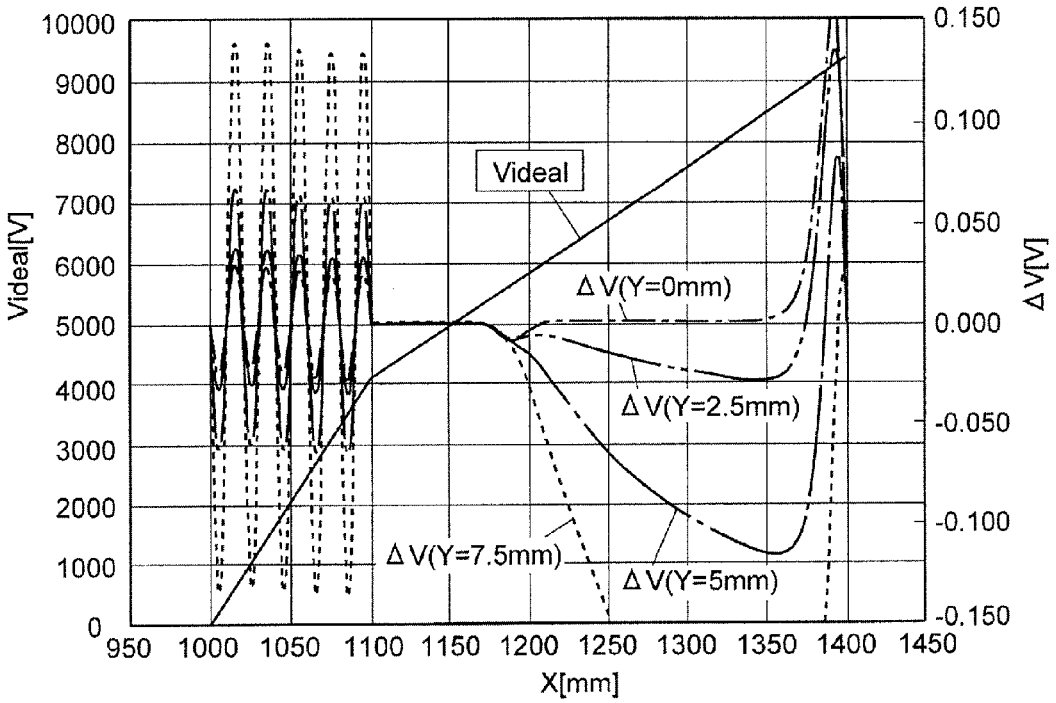
FIG. 5 is a diagram showing a simulation result of a potential distribution on a center axis and on paths deviating from the center axis in the ion reflector having the structure shown in FIG. 4.
Figure 6:
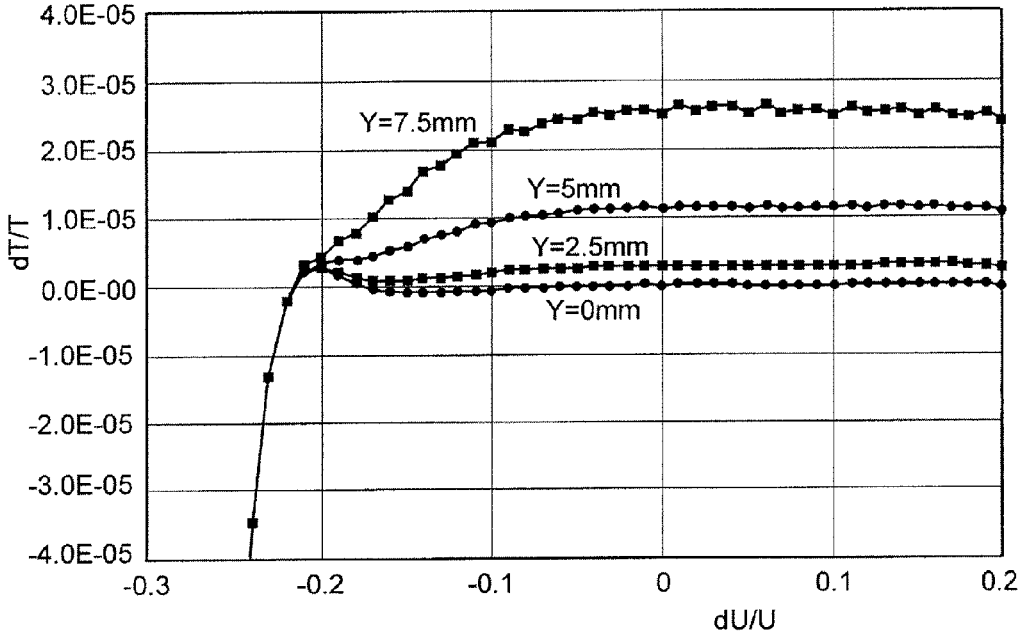
FIG. 6 is a diagram showing a simulation result of a relative time spread dT/T with respect to a relative energy spread dU/U in the case in which ions fly on the center axis and on the paths deviating from the center axis in the ion reflector having the structure shown in FIG. 4.

FIG. 5 is a diagram showing a simulation result of potential distributions on a center axis (Y=0 [mm]) and paths (Y=2.5, 5, and 7.5 [mm]) deviating from the center axis in the ion reflector according to the modification shown in FIG. 4. As in FIG. 15, Videal represents an ideal potential distribution obtained by superimposing correcting potential on potential of the uniform electric field and ΔV represents a distribution of potential deviation between ideal potential and actual potential. FIG. 6 is a diagram showing a simulation result of the relative time-of-flight spread dT/T with respect to the relative energy spread dU/U in the case in which ions fly on the center axis and the paths deviating from the center axis in the ion reflector according to the modification shown in FIG. 4.

As is evident from the comparison with FIG. 5 and FIG. 15, in the structure shown in FIG. 4, since the guard-ring electrodes 42 disposed in the second stage region S2 are reduced in thickness, it is seen that the unevenness of the potential conspicuous at, in particular, Y=5 and 7.5 [mm] away from the center axis is substantially reduced. Since the unevenness of the potential is greatly improved in this way, as shown in FIG. 6, it is seen that the spread of the time of flight is greatly improved even on the tracks away from the center axis. That means, with the TOFMS in this embodiment, not only an ion packet flying on the center axis but also an ion packet flying on the paths away from the center axis realize isochronism at a high level and attain high mass-resolving power. With the structure shown in FIG. 3 and FIG. 4, there is not only an advantage to reduce unevenness of the potential in the ion reflection region that greatly affects the mass-resolving power but also an advantage to reduce the number of the guard-ring electrodes 41 disposed in the first stage region S1 compared with the conventional structure. The reduction above is combined with usage of the common spacers so that further effective in cost reduction is achieved.

Figure 7:
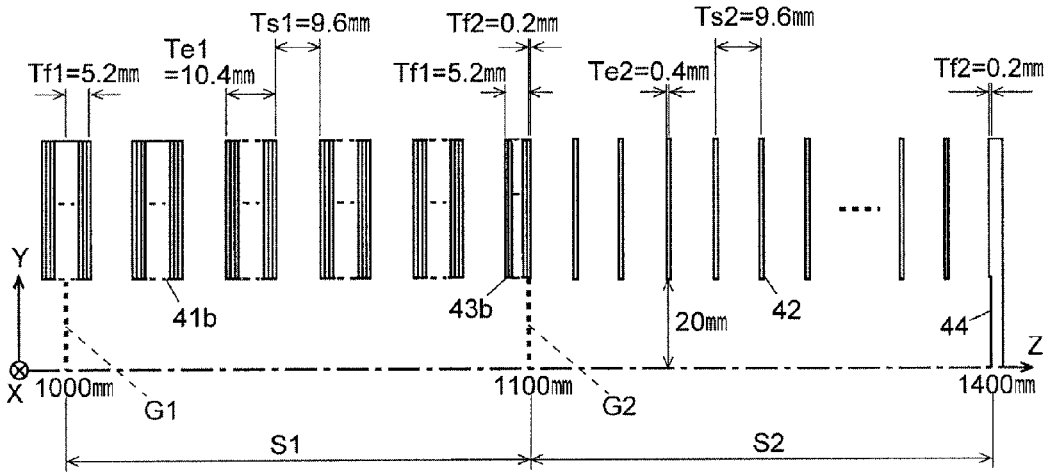
FIG. 7 is a diagram showing another modification of the electrode structure of the ion reflector in the TOFMS in the embodiment.
Figure 8A:
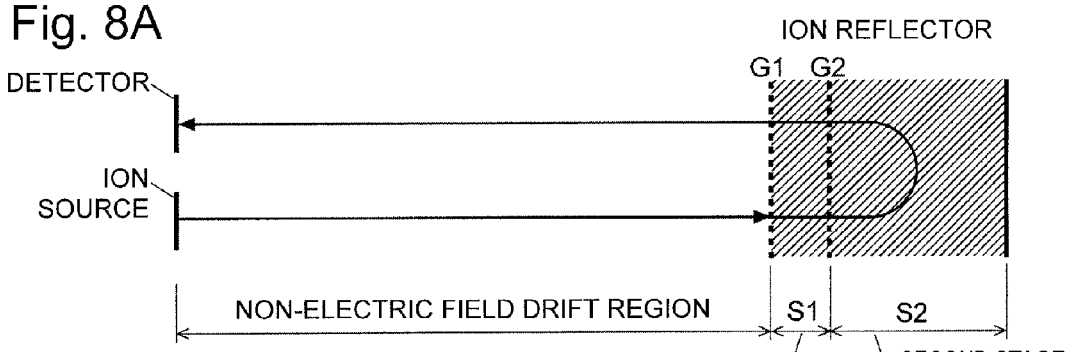
FIG. 8A is a schematic diagram showing an ion path in a dual-stage reflectron of the conventional technique and FIG. 8B is a schematic diagram of a potential distribution on the center axis.
Figure 8B:
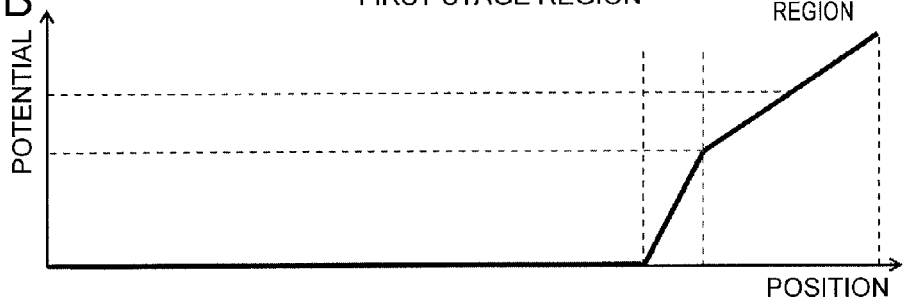
Figure 9:
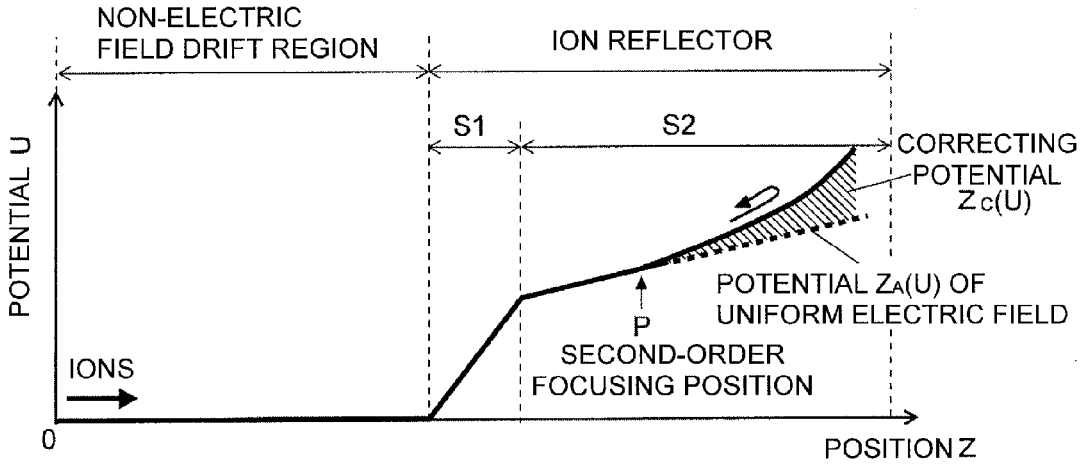
FIG. 9 is a conceptual diagram of a potential distribution of a dual-stage reflectron described in Patent Literature 1.

In order to further reduce the manufacturing costs of the ion reflector, a member constituting the thick electrode disposed in the first stage region S1 and a member constituting the thin electrode disposed in the second stage region S2 may be a common member. FIG. 7 shows a modification of the electrode structure of the ion reflector where electrode arrangement is the same as that shown in FIG. 3 but the thick guard-ring electrode disposed in the first stage region S1 is formed with a stacked structure of a plurality of thin electrodes. In this example, a guard-ring electrode 41*b* having thickness Te1=10.4 [mm] disposed in the first stage region S1 is formed by stacking twenty-six guard-ring electrodes 42 having thickness Te2=0.4 [mm] disposed in the second stage region S2. A guard-ring electrode 43*b*, to which the second grid electrode G2 is attached, is formed by stacking thirteen guard-ring electrodes 42 having thickness Te2=0.4 [mm] and further stacking one metal plate having thickness of 0.2 [mm] on the guard-ring electrodes 42. By using a general-purpose machining technique such as etching or punching, thin metal plate having the same shape and the same thickness is inexpensively produced in a large volume from a thin large metal plate. By forming the thick electrode using the metal plate member used in the thin electrode in this way, costs are reduced compared with when the thick electrode is manufactured by machining.

In the example shown in FIG. 7, the metal plate having thickness of 0.4 [mm] is used for both the electrodes 41*b* and 42. Similarly, by using the thickness of the metal plate to 0.2 [mm], metal plate members having thickness Tf2 in the electrode 43*b* and the terminal end electrode 44 can be used in common.

As it is seen when the potential distributions shown in FIG. 5 and FIG. 15 are compared, in the ion reflector according to this embodiment, instead unevenness of the potential in the second stage region S2 decreases, unevenness of the potential in the first stage region S1 increases. This results from the influence on the increased thickness of the guard-ring electrodes 41 disposed in the first stage region S1. However, as indicated by the simulation result, regardless of the increase in the unevenness of the potential in the first stage region S1, for example, the spread of the time of flight of the ions flying on the center axis hardly increases. Consequently, the unevenness of the potential in the first stage region S1 does not greatly affect isochronism.

In the simulation, the ideal potential distribution is formed by introducing the non-uniform electric field into the second stage region S2 using the method described in Patent Literature 1. The sufficient advantage is also obtained in the TOFMS using the conventional ion reflector that forms only the uniform electric field by applying the present invention. In the conventional dual-stage (or multistage) ion reflector that forms the uniform electric field, it is also necessary to suppress unevenness of potential in the ion reflection region in order to improve mass-resolving power. To address this, the conventional ion reflector uses, as the ion flight space, the region near the center axis where the unevenness of the potential is sufficiently small. For the conventional ion reflector, the region near the center axis where the unevenness of the potential is sufficiently small increases as the guard-ring electrodes are further reduced in thickness. Therefore, using the thin electrode as the guard-ring electrodes disposed in the region where the ions are reflected reduces the diameter of the ion reflector so as to advantageously allow the entire device to be compact.

In the simulation, the opening shape of the guard-ring electrodes of the ion reflector has been assumed to be the round hole or the infinitely long slit shape. However, not only that, but guard-ring electrodes having an opening shape of a rectangular shape or a long hole shape may be used. In the case of a configuration in which ions are made incident obliquely to the center axis of the reflectron in order to dispose the ion ejector and the detector spatially apart from each other, it is convenient to use the guard-ring electrodes having the opening shape of the rectangular shape or the long hole shape, because it secures a wide space region, which achieves a high mass-resolving power, in one direction. These opening shapes achieve satisfactory performance the same as those of the round hole or the infinitely long slit shape.

The simulation is an example of the case where the present invention is applied to the dual-stage reflectron. The present invention also can be applied to an ion reflector including three or more stages. In the case of the ion reflector including the three or more stages, a final stage is an ion reflection region and the other stages are ion deceleration regions.

Furthermore, the embodiment is an example of the present invention. It goes without saying that appropriate modifications, corrections, and additions of the embodiment in the scope of the gist of the present invention are also included in the scope of claims.

REFERENCE SIGNS LIST

1 . . . Ion Source
2 . . . Ion-Accelerating Region
3 . . . Flight Tube
4 . . . Ion Reflector
41, 42, 43, 41*b*, 43*b* . . . Guard-Ring Electrodes
44 . . . Terminal End Electrode
5 . . . Detector
6 . . . Reflector DC Voltage Source
7 . . . Accelerating Voltage Source
8 . . . Controller
9 . . . Data Processor
G, G1, G2 . . . Grid Electrodes
S1 . . . First Stage Region
S2 . . . Second Stage Region

The invention claimed is:

1. A time-of-flight mass spectrometer comprising:

an ion ejector configured to impart a predetermined amount of energy to target ions;

an electric field-free ion drift region configured to let the ions drift;

an ion reflector, including a plurality of plate-like electrodes that provide an electric field, disposed along an ion path and configured to receive ions from the electric field-free ion drift region and to reflect and return, with action of the electric field, the ions to the electric field-free ion drift region;

a detector configured to detect the ions reflected by the ion reflector, wherein a flight space of the ions in the ion reflector is sectioned into a first region where the ions passed through the electric field-free ion drift region are decelerated and a second region where the ions passed through the first region are reflected, wherein a plurality of electrodes disposed in the second region has a same thickness, wherein a thickness of any electrode in the second region is smaller than a thickness of any electrode in the first region, and wherein a mass resolving power of the time-of-flight mass spectrometer is 10000 or more.

2. The time-of-flight mass spectrometer according to claim 1, wherein boundary between the electric field-free ion drift region and the first region of the ion reflector and boundary between the first region and the second region of the ion reflector are respectively partitioned by grid electrodes stretched to openings of the electrodes constituting the ion reflector.

3. The time-of-flight mass spectrometer according to claim 2, wherein the grid electrode that partitions the electric field-free ion drift region and the first region of the ion reflector is stretched to a first electrode disposed in the first region, thickness of the first electrode is equal to or larger than a half of thickness of other electrodes disposed in the first region, the other electrodes disposed in the first region having a same thickness, and the grid electrode that partitions the first region and the second region of the ion reflector is stretched to an electrode having thickness equal to a sum of a half of thickness of the other electrodes disposed in the first region and a half of thickness of the electrodes having a same thickness disposed in the second region.

4. The time-of-flight mass spectrometer according to claim 1, wherein an opening of the electrodes disposed in the first region is larger than an opening of the electrodes disposed in the second region.

5. The time-of-flight mass spectrometer according to claim 1, wherein spacers are sandwiched between electrodes adjacent to one another in the electrodes constituting the ion reflector, and thickness of the electrodes and disposition of the electrodes are adjusted to form all the spacers in same thickness.

6. The time-of-flight mass spectrometer according to claim 1, wherein the electrode in the first region is formed by stacking a plurality of thin electrodes, the thin electrodes having a same thickness as the electrode disposed in the second region.

7. The time-of-flight mass spectrometer according to claim 1, wherein a pitch of a plurality of electrodes disposed in the first region is wider than a pitch of a plurality of electrodes disposed in the second region, and a number of electrodes per unit length is small in the first region compared with the second region.

8. A time-of-flight mass spectrometer comprising:

an ion ejector configured to impart a predetermined amount of energy to target ions;

an electric field-free ion drift region configured to let the ions drift;

an ion reflector including a plurality of plate-like electrodes that provide an electric field, disposed along an ion path and configured to receive ions from the electric field-free ion drift region and to reflect and return, with action of the electric field, the ions to the electric field-free ion drift region;

a detector configured to detect the ions reflected by the ion reflector, wherein a flight space of the ions in the ion reflector is sectioned into a first region where the ions passed through the electric field-free ion drift region are decelerated and a second region where the ions passed through the first region are reflected, wherein a plurality of electrodes disposed in the second region has a same thickness, wherein a thickness of any electrode in the second region is approximately 2 mm or less and a thickness of any electrode in the first region is in a range of 5 mm or more, and wherein a mass resolving power of the time-of-flight mass spectrometer is 10000 or more.

9. The time-of-flight mass spectrometer according to claim 8, wherein the electric field-free ion drift region and the first region of the ion reflector and the first region and the second region of the ion reflector are respectively partitioned by grid electrodes stretched to openings of the electrodes constituting the ion reflector.

10. The time-of-flight mass spectrometer according to claim 9, wherein the grid electrode that partitions the electric field-free ion drift region and the first region of the ion reflector is stretched to a first electrode disposed in the first region, thickness of the first electrode is equal to or larger than a half of thickness of other electrodes disposed in the first region, the other electrodes disposed in the first region having a same thickness, and the grid electrode that partitions the first region and the second region of the ion reflector is stretched to an electrode having thickness equal to a sum of a half of thickness of the other electrodes disposed in the first region and a half of thickness of the electrodes having a same thickness disposed in the second region.

11. The time-of-flight mass spectrometer according to claim 8, wherein the thickness of any electrode in the first region is in a range of 5 to 10 mm.

* * * * *